US010029843B2

(12) United States Patent
Roh

(10) Patent No.: US 10,029,843 B2
(45) Date of Patent: Jul. 24, 2018

(54) FALSE EYELASH DISPENSER

(71) Applicant: ELC Management LLC, Melville, NY (US)

(72) Inventor: Yeon Jung Roh, Astoria, NY (US)

(73) Assignee: ELC Management LLC, Melville, NY (US)

( * ) Notice: Subject to any disclaimer, the term of this patent is extended or adjusted under 35 U.S.C. 154(b) by 0 days.

(21) Appl. No.: 15/441,350

(22) Filed: Feb. 24, 2017

(65) Prior Publication Data

US 2017/0253418 A1 Sep. 7, 2017

Related U.S. Application Data

(60) Provisional application No. 62/304,441, filed on Mar. 7, 2016.

(51) Int. Cl.

| | |
|---|---|
| ***B26F 3/02*** | (2006.01) |
| ***B65H 35/10*** | (2006.01) |
| ***B65D 83/00*** | (2006.01) |
| ***A41G 5/02*** | (2006.01) |
| ***B65D 83/08*** | (2006.01) |
| ***B65H 37/00*** | (2006.01) |

(52) U.S. Cl.

CPC ..... *B65D 83/0083* (2013.01); *A41G 5/02* (2013.01); *B65D 83/087* (2013.01); *B65H 37/005* (2013.01)

(58) Field of Classification Search

CPC ..... B65D 83/00; B65D 83/0083; B65D 83/0864; A41G 5/02; A45D 44/00

USPC ..... 221/71; 225/57; 132/216

See application file for complete search history.

(56) References Cited

U.S. PATENT DOCUMENTS

| | | | | |
|---|---|---|---|---|
| 2,667,176 | A * | 1/1954 | Wassmer | A41G 5/02 132/216 |
| 5,579,669 | A * | 12/1996 | Kind | B26D 5/20 83/13 |
| 6,453,968 | B1 * | 9/2002 | Hsu | B65H 35/0033 118/257 |
| 7,205,009 | B2 | 4/2007 | Stass | |
| 8,322,262 | B2 * | 12/2012 | Ryu | B65H 37/005 221/30 |

(Continued)

FOREIGN PATENT DOCUMENTS

| | | | |
|---|---|---|---|
| EP | 1834914 | 9/2007 | |
| EP | 1834914 A1 * | 9/2007 | A61M 35/003 |

(Continued)

OTHER PUBLICATIONS

PCT International Search Report; International Application No. PCT/US2017/012971; Completion Date: Apr. 18, 2017; Dated: Apr. 19, 2017.

(Continued)

*Primary Examiner* — Rakesh Kumar

(74) *Attorney, Agent, or Firm* — Idris N. McKelvey

(57) ABSTRACT

The present invention relates to an apparatus for dispensing false eyelashes. The apparatus includes a dispensable tape, the tape being loaded with false eyelashes, and the eyelashes being delivered to a user's eyelashes by advancing them forward on the tape. The apparatus further includes an upper and lower clamping mechanism, designed to assist the user, by clamping down on dispensed eyelashes, facilitating more accurate application of the false eyelashes.

7 Claims, 10 Drawing Sheets

(56) References Cited

U.S. PATENT DOCUMENTS

| | | | | |
|---|---|---|---|---|
| 8,720,521 | B1 * | 5/2014 | Peary | B65H 35/0033 156/523 |
| 9,815,655 | B2 * | 11/2017 | Crapet | B65H 37/005 |
| 2003/0224028 | A1 | 12/2003 | Galey | |
| 2006/0008428 | A1 | 1/2006 | Seyler | |
| 2006/0165644 | A1 | 7/2006 | Tanaka | |
| 2006/0210515 | A1 | 9/2006 | Mower | |
| 2009/0117061 | A1 | 5/2009 | Gross | |
| 2012/0000957 | A1 * | 1/2012 | Martinez | A41G 5/02 225/57 |
| 2012/0195923 | A1 | 8/2012 | Turgeon | |
| 2013/0042884 | A1 * | 2/2013 | Wilkinson | A41G 5/02 132/216 |
| 2014/0086893 | A1 | 3/2014 | Gutmann | |
| 2014/0261514 | A1 | 9/2014 | Martins | |
| 2014/0263392 | A1 * | 9/2014 | Martins | B65D 83/0864 221/71 |
| 2015/0020840 | A1 * | 1/2015 | Rabe | A41G 5/02 132/216 |
| 2015/0181968 | A1 | 7/2015 | Uresti | |
| 2015/0374613 | A1 | 12/2015 | Kirakosyan | |
| 2017/0253418 | A1 * | 9/2017 | Roh | A41G 5/02 |

FOREIGN PATENT DOCUMENTS

| | | | | |
|---|---|---|---|---|
| FR | 2990605 | A1 * | 11/2013 | A41G 5/0086 |
| FR | 2990606 | A1 * | 11/2013 | A41G 5/02 |
| FR | 3013198 | * | 6/2016 | A41G 5/02 |
| JP | 02142717 | | 5/1990 | |
| JP | 2001-163718 | | 6/2001 | |
| JP | 2006-028118 | | 2/2006 | |
| WO | WO-2015/075153 | | 5/2015 | |
| WO | WO-2015075153 | A1 * | 5/2015 | A41G 5/02 |

OTHER PUBLICATIONS

PCT International Search Report; International Application No. PCT/US2017/012963; Completion Date: Apr. 18, 2017; Dated: Apr. 19, 2017.

PCT International Search Report; International Application No. PCT/US2017/012981; Completion Date: Apr. 18, 2017; Dated: Apr. 18, 2017.

PCT International Search Report; International Application No. PCT/US2017/012985; Completion Date: Apr. 18, 2017; Dated: Apr. 18, 2017.

PCT International Search Report; International Application No. PCT/US2017/019018; Completion Date: May 25, 2017; Dated: May 25, 2017.

PCT International Search Report; International Application No. PCT/US2017/019242; Completion Date: Jun. 5, 2017; Dated: Jun. 7, 2017.

PCT Written Opinion of the International Searching Authority; International Application No. PCT/US2017/012963; Completion Date: Apr. 18, 2017; Dated: Apr. 19, 2017.

PCT Written Opinion of the International Searching Authority; International Application No. PCT/US2017/012971; Dated: Apr. 19, 2017; Completion Date: Apr. 18, 2017.

PCT Written Opinion of the International Searching Authority; International Application No. PCT/US2017/012981; Dated: Apr. 18, 2017; Completion Date: Apr. 18, 2017.

PCT Written Opinion of the International Searching Authority; International Application No. PCT/US2017/012985; Completion Date: Apr. 18, 2017; Dated: Apr. 18, 2017.

PCT Written Opinion of the International Searching Authority; International Application No. PCT/US2017/019018; Completion Date: May 25, 2017; Dated: May 25, 2017.

PCT Written Opinion of the International Searching Authority; International Application No. PCT/US2017/019242; Dated: Jun. 7, 2017; Completion Date: Jun. 5, 2017.

Shin, Kyungha et al.; Effectiveness of the combinational treatment of Laminaria japonica and Cistanche tubulosa extracts in hair growth; Laboratory Animal Research, 2015, vol. 31, No. 1, pp. 24-32.

Asl et al. "Review of pharmacological effects of *Glycyrrhiza* sp. and its bioactive compounds," Phytotherapy Research 22:709-724,2008.

Ducrey et al. "Inhibition of Sa-reductase and aromatase by the eliagitannins oenothein A and oenothein B from *Epitobium* species," Planta Medica 63:111-114, 1997.

English abstract RU 2441638, dated Feb. 10, 2012.

Machine translation JP 2001-163718, printed 2017.

Machine translation JP 2006-028118, printed 2017.

Sarkar "How men should shampoo hair," Jan. 6, 2014; http://www.mensxp.com/g rooming/hair-care/214 74-how-men-should- shampoo-hair.html.

Vitalone et al. "Characterization of the effect of Epilobium extracts on human cell proliferation," Pharmacology 69:79-87, 2003.

* cited by examiner

FALSE EYELASH DISPENSER

FIELD OF THE INVENTION

This invention relates to an apparatus for dispensing false eyelashes.

BACKGROUND OF THE INVENTION

Applying false eyelashes is handling and applying false eyelashes can be cumbersome, messy, and inaccurate. With currently available products, applying false eyelashes takes skill and practice. One must use glue to adhere the false eyelashes to the eyelids. One must let the glue achieve the correct amount of "tackiness" and then apply without gumming up the eyelashes and ruining the product, or worse, damaging the eye itself. Although there are false eyelashes available with self-adhesive glue already on the lashes, these leave the glue residue on the real eyelashes and can result in removing the person's own lashes along with the false eyelashes.

Previous attempts to address these issues include false eyelash strips, which may include predetermined doses of adhesive. The strips are generally provided in predetermined lengths, which may not match the length of the eyelid to which they are applied. Also, the base of the strip of false lashes is readily visible, which reduces their natural appearance. False eyelash dispensers have been employed, which may include a cutting means for obtaining a more accurate length for application to the eyelid. But again, the base of the strip, or backbone, remains visible, and the device requires some skill on the part of the user to properly measure the strip before application. This creates a large margin for user error and does not overcome limits to the natural appearance of the false lashes.

To be applied effectively, and with a natural appearance, a false eyelash needs to be delivered to an eyelash or eyelid as individual lashes or lash clusters. The invention herein provides such lashes in a form-factor which enables easy application.

SUMMARY OF THE INVENTION

The present invention relates to an apparatus for dispensing false eyelashes. The apparatus includes a dispensable tape, the tape being loaded with false eyelashes, and the eyelashes being delivered to a user's eyelashes by advancing them forward on the tape. The apparatus further includes an upper and lower clamping mechanism, designed to assist the user, by clamping down on dispensed eyelashes, facilitating more accurate application of the false eyelashes. These, and other features of the present invention, are described in detail hereinafter.

DETAILED DESCRIPTION OF THE INVENTION

The apparatus stores and delivers false eyelashes ("lashes on tape") conveniently in a manner that allows for easy and accurate application of false eyelashes that are dispensed individually or in false eyelash clusters. The invention comprises false eyelashes that are dispensed from tape perpendicularly to the dispensing edge of the tape. The false eyelashes are dispensed from individual patches of adhesive on the tape. Because the false eyelashes are dispensed individually, rather than a single strip of false eyelashes, they can be stylized, curved, elongated, or otherwise differentiated from one another.

Common eyelash types include human hairs, synthetic hairs, nylon, fibers, threads, or even fiber optics. The tape is preferably medical-grade, fabric-covered tape. However, other types of tapes are functional equivalents, such as plastics. The false eyelashes should be treated, or pretreated, with an adhesive at their distal ends to facilitate application to a human eyelid or eyelash. Suitable adhesives include medical grade such as Elastoplast®, and are sufficiently tacky to secure the false eyelashes to the user's eyelashes or eyelid, but not so tacky as to harm the user.

Figure 1:
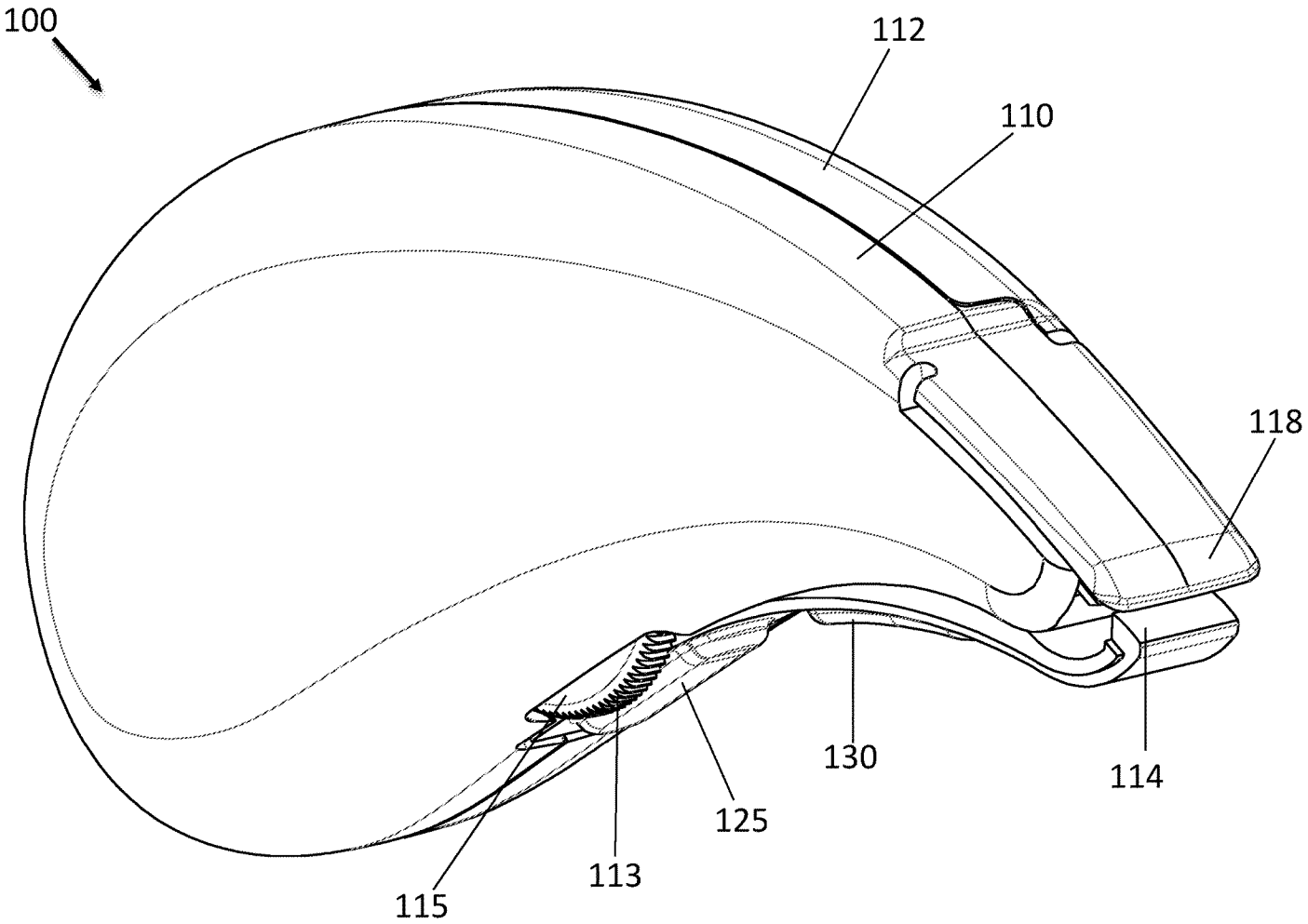
FIG. 1 is a perspective view of the apparatus.

FIG. 1 shows a perspective view of an apparatus 100 for dispensing false eyelashes. The apparatus 100 includes a casing defined by a first body 110 and a second body 112. The first and second bodies 110 and 112 are fastened to one another via any practical means such as screws, clips, bolts, pins, and the like. To form a more consumer-acceptable casing, fasteners such as rivets, magnets, or other more easily-removable connections may be employed. The casing may include an opening between the first and second bodies 110, and 112. The opening may extend around the perimeter of the casing, or the first and second bodies 110 and 112 may be flush around their edges, while exposing an opening at its distal end, forming a lower and upper clamp 114, 118. An actuating wheel 115 is generally positioned in the lower-intermediate portion of the casing and is provided to enable the dispensing of false eyelashes. The actuating wheel 115 may be formed with a textured surface such as cogs 113 to provide a surface for actuation by a user's finger. Preferably, adjacent to the actuation wheel 115, is a first and second button 125, 130 for opening and closing the lower clamp 114. In one embodiment, the first and second buttons 125, 130 comprise a tactile surface or otherwise protrude from the apparatus 100. Exemplary tactile surfaces include bumps, grooves, a rubber or polymeric gripping surface, and the like. As the apparatus 100 may be used with the user's attention being drawn to the application process, a tactile surface may assist the user to locate the first and second buttons 125, 130 without having to visually locate their positions. The tactile surfaces of the first and second buttons 125, 130 may be the same or different from one another. In one embodiment, the tactile surfaces comprise different materials. The tactile difference may indicate to the user whether the respective surface operates to open or close the lower clamp 114. The clamping mechanism facilitates improved control over accurate dispensing of the false eyelashes herein.

Figure 2A:
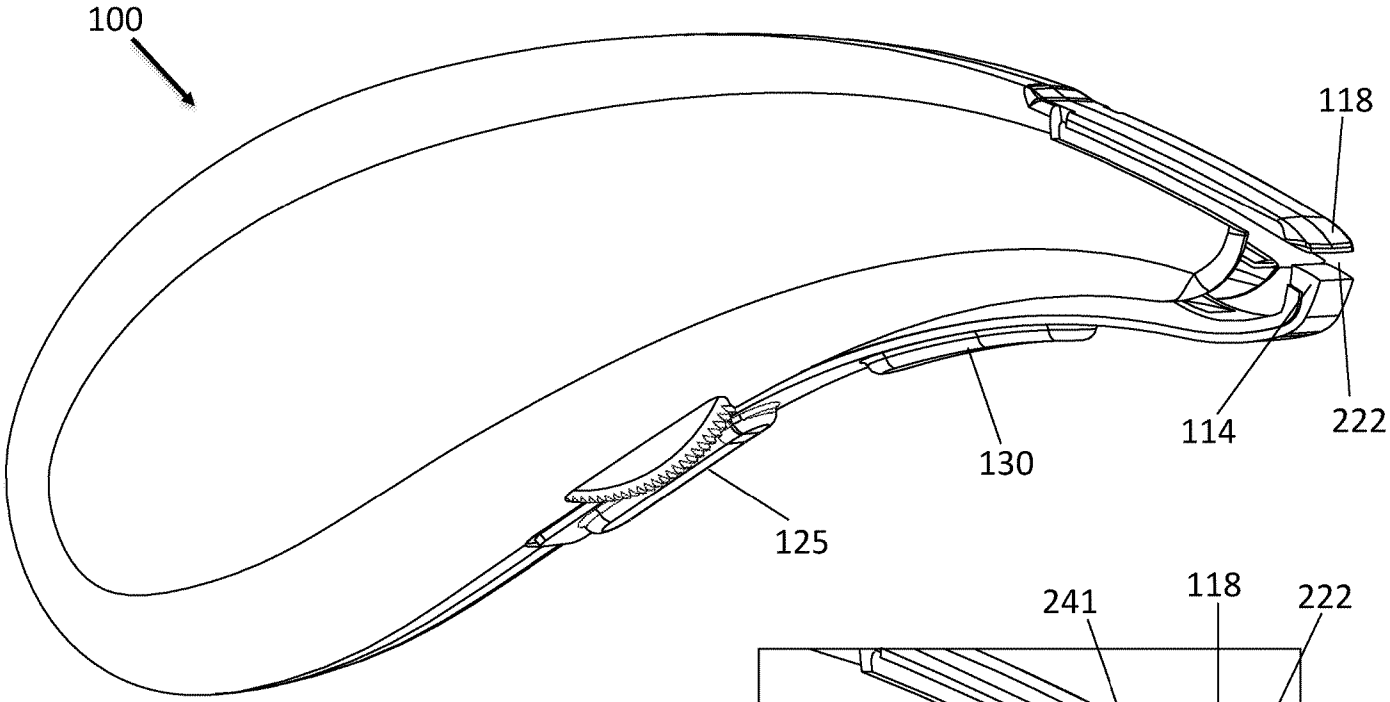
FIG. 2A is a side view of the apparatus with its lower clamp in the open position.
Figure 2B:
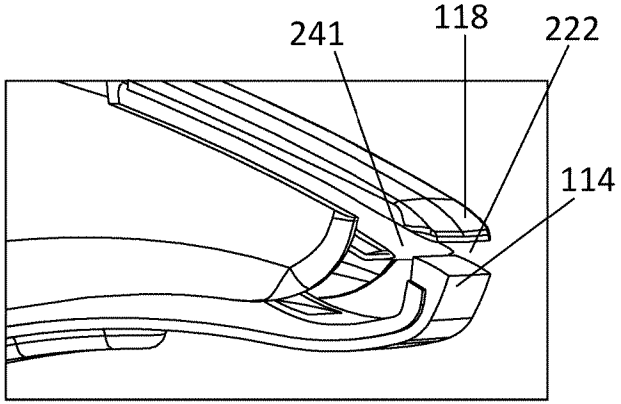
FIG. 2B is a close-up view of the dispensing end of the apparatus, in the open position.

FIG. 2A shows a side-view of an embodiment of the apparatus 100 with the lower clamp 114 in an open position. The opening 222 created by the open lower clamp 114 enables false eyelashes to be dispensed from the opening 222. The opening 222 is provided when the first button 125 is activated by the user. In one embodiment, activation of the first button 125 also disengages the second button 130. FIG. 2B provides a close-up view of the lower and upper clamps 114, 118 and opening 222. Also visible is the dispensing edge 241, which facilitates a pivot point for the dispensing tape (not shown in FIGS. 2A and 2B) to dispense false eyelashes through the opening 222.

Figure 2C:
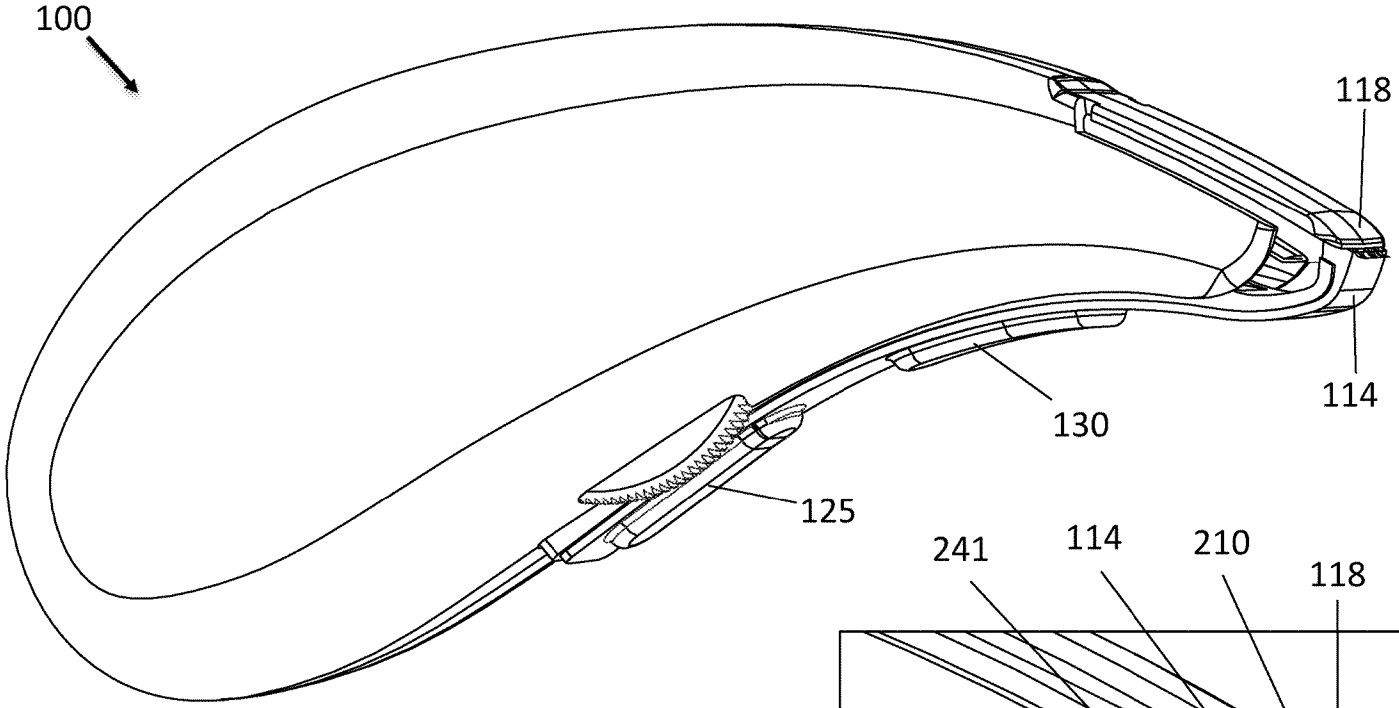
FIG. 2C is a side view of the apparatus with its lower clamp in the closed position.
Figure 2D:
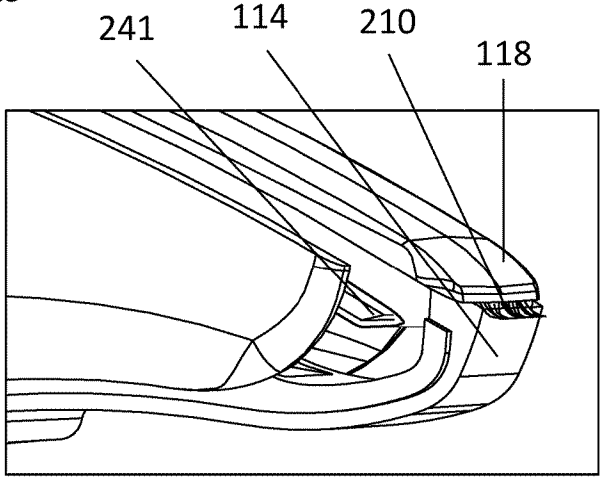
FIG. 2D is a close-up view of the dispensing end of the apparatus, in the closed position.

FIG. 2C shows a side-view of an embodiment of the apparatus 100 with the lower clamp 114 in a closed position. FIG. 2E provides a close-up view of the lower clamp 114 in a closed position and holding false eyelashes 210 in place. Clamping the false eyelashes 210 provides the user with greater control and dexterity for accurate application of the false eyelashes 210 to the user's eyelid. The false eyelashes 210 may be treated with a cosmetically acceptable adhesive or glue to be fixed to a user's eyelid or existing eyelashes. Closing the lower clamp 114 as the user applies the false eyelashes 210 to her own eyelashes or eyelid enables the user to press the false eyelashes 210 into place with sufficient force to firmly fix them in place. In the absence of such a closure, as is provided by the lower and upper clamps 114, 118, the false eyelashes 210 are easily displaced from the dispensing device, making it very difficult to accurately apply the false eyelashes 210.

Figure 3A:
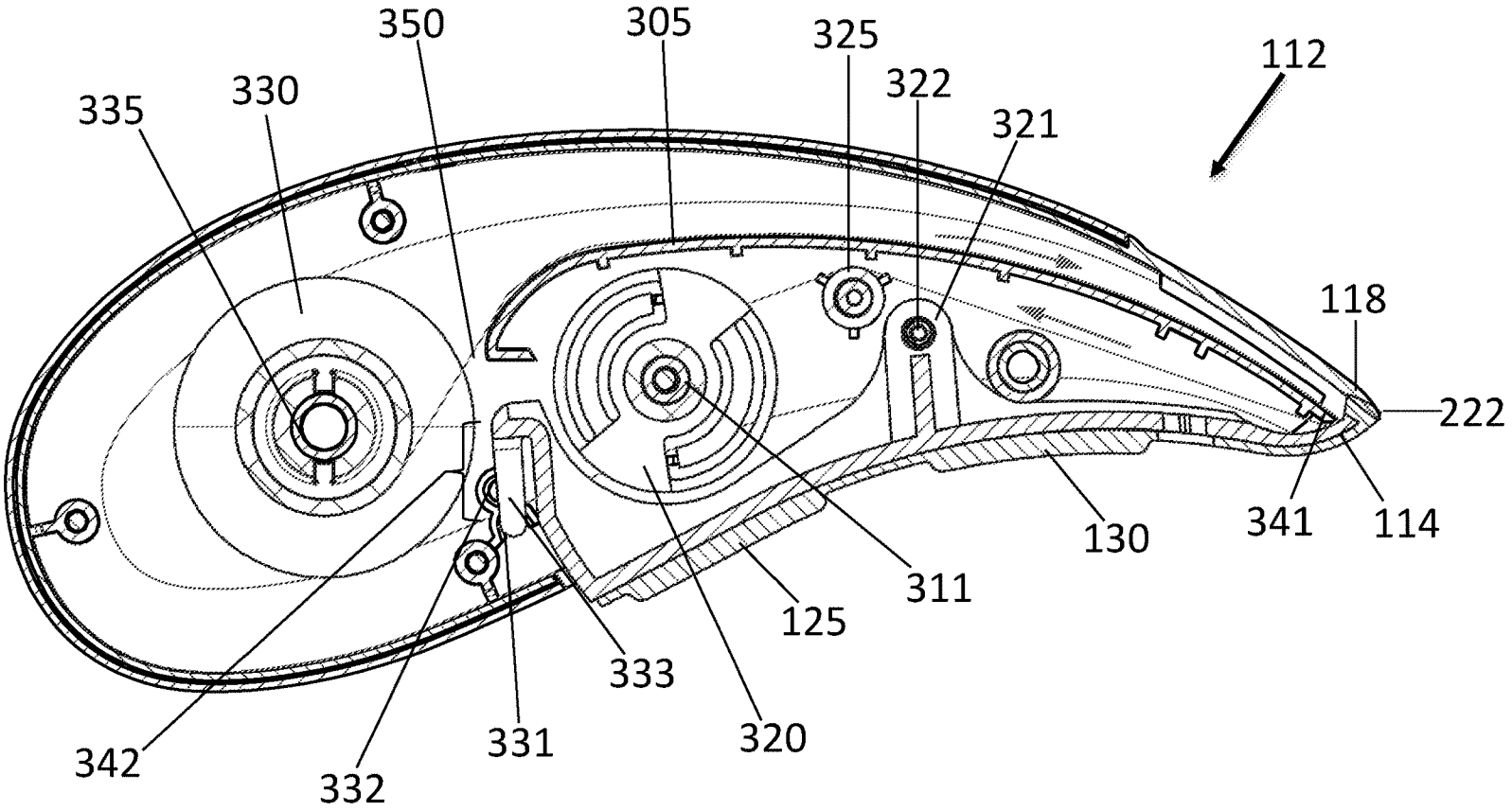
FIG. 3A is side cutaway view of the apparatus, showing its internal components, and the lower clamp being in the closed position.

FIG. 3A shows a side view of the internal components of the dispenser, as the components are configured against the second body 112. The second body 112 is molded with a tape-supporting molded surface 305 provided to support and guide the path of the dispensing tape 350 from the supply wheel 330 to its dispensing tip 341. The supply wheel 330 is preloaded with false eyelashes and sits on a supply axle 335. As the dispensing tape advances over the dispensing tip 341, it returns over a guide-wheel 325, which directs the dispensing tape 350 to a take-up wheel 320. The take-up wheel 320 sits on a take-up axle 311 to facilitate rotation. The take-up wheel 320 is in communication with the actuating wheel, shown in FIGS. 1, 4, and 7. FIG. 3A shows the opening 222 in a closed position, where the lower and upper clamps 314, 118 are compressed towards one another. The closed position is enabled by the user pushing a first button 125. The pushing force pivots the lower clamp 114 into its closed position. And the pivot action is facilitated by the first and second buttons 125, 130 being in communication with a pivot point 321 and pivot fulcrum 322. The base of the second button 130 is in communication with a locking arm 333 which is formed with a locking feature, designed to match a first and second locking position 331, 332, creating a locking mechanism 342. The locking mechanism 342 operates in tandem with the open and closed position of the lower and upper clamps 114, 118. As shown, when the lower clamp 114 is in the closed position, the locking arm 333 is locked in the first locking position 331.

Figure 3B:
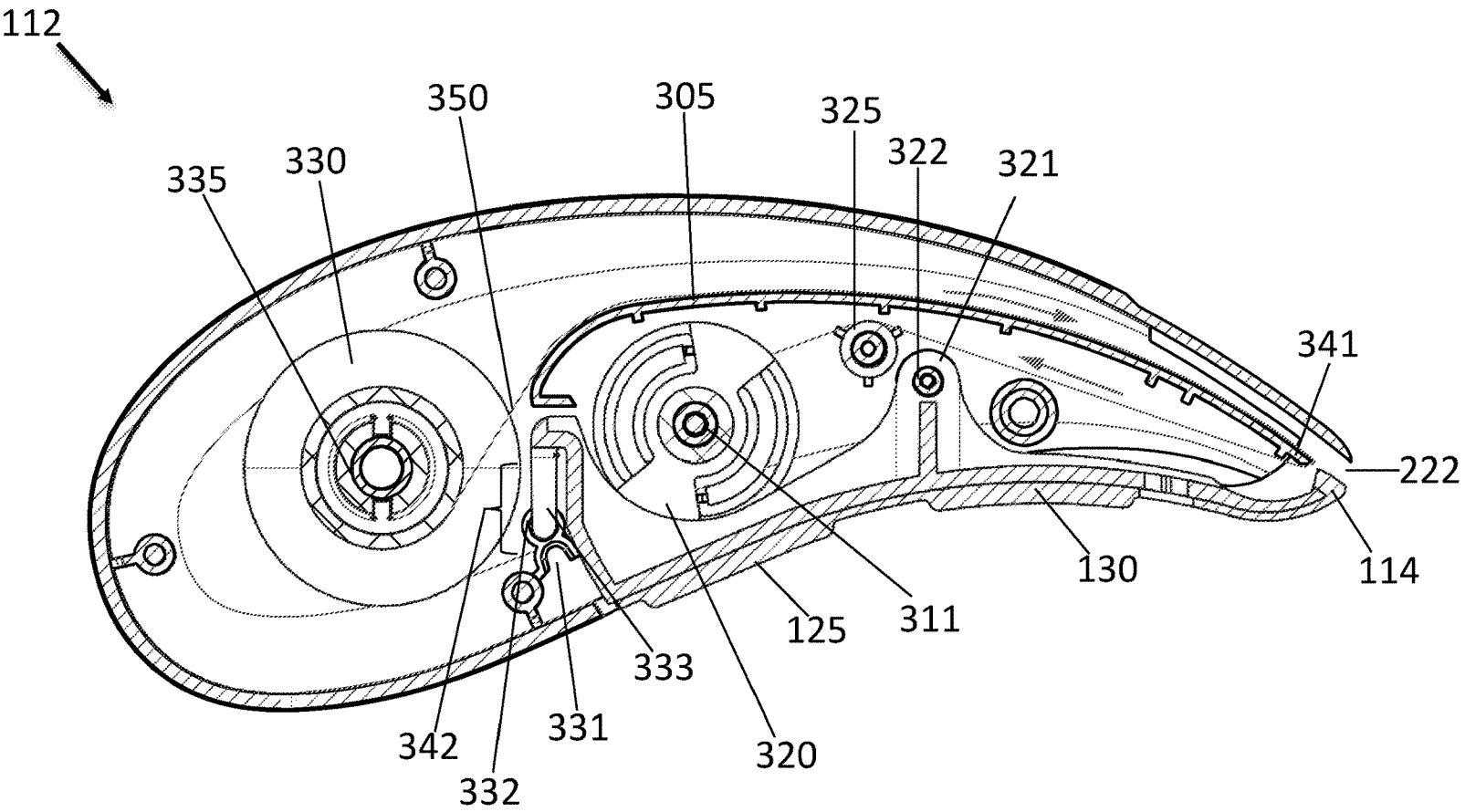
FIG. 3B is side cutaway view of the apparatus, showing its internal components, and the lower clamp being in the closed position.

FIG. 3B shows the lower clamp 114 in the open position due to a push force being applied to the second button 130. The push force moves the locking arm 333 into the second locking position 332, and an opening 222 is created which facilitates advancement of the dispensing tape 350 for dispensing false eyelashes. In turn, the locking arm 333 is also moved into its second locking position 332, which fixes the lower clamp 114 in its open position. While the lower clamp 114 is in the open position, the user can advance the dispensing tape 350 to dispense the false eyelashes.

The take-up wheel 320 is configured to draw the dispensing tape 350 from the supply wheel 330, which facilitates dispensing of the false eyelashes. The movement of the take-up wheel 320 may be facilitated by any suitable actuation means known in the art. For example, the supply wheel 330 may be coupled to a trigger, button, gear, wheel, or other means for advancing rotation of the take-up wheel 320. As the dispensing tape 350 advances from the supply wheel 330, it passes over the molded surface 305 to the dispensing tip 341, then it returns over the guide-wheel 325 and is ultimately wound into the spool of the take-up wheel 320.

Figure 4:
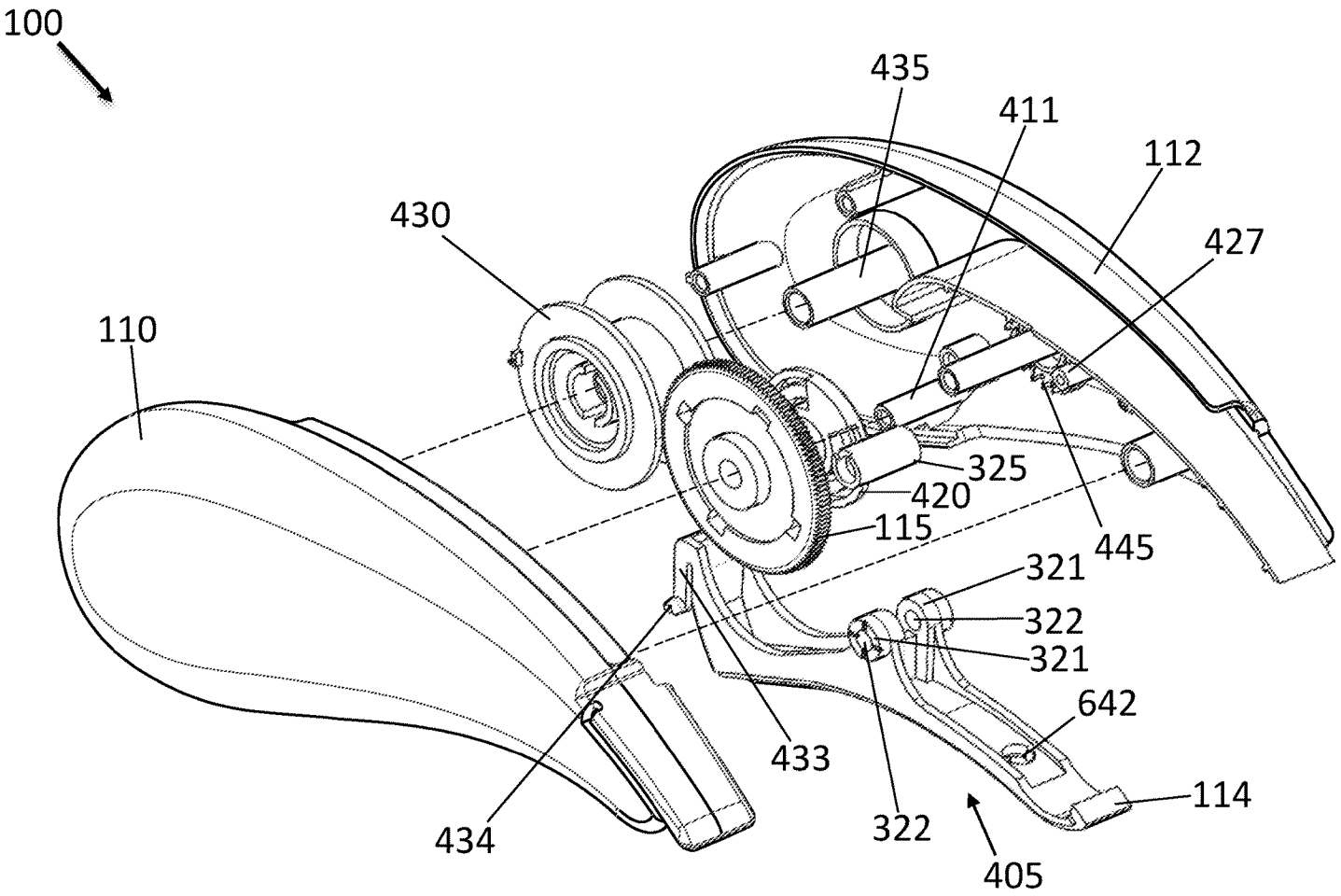
FIG. 4 shows an exploded view of the apparatus herein.

FIG. 4 is an exploded view of the apparatus, showing the first and second bodies 110, 112, which house all of the internal components. The dispensing wheel 430 sits on its axle 435. And the take-up wheel 320 sits on its axle 411. The take-up wheel 420 is also in communication with the actuating wheel 115, which, in this embodiment, protrudes through the bottom of the apparatus 100, providing the user with an actuating means for advancing the tape. The tape is further supported by a guide-wheel 325, which sits on its axle 427. Also shown is the pivot arm 405 which includes the lower clamp 114, the pivot point 321 pivot fulcrum 322, and the locking arm 333. FIG. 4, also shows an embodiment including a protruding locking peg 434 and an eyelet 642, each of which are discussed hereinafter. Also shown is an anti-rollback means 445, which engages the take-up wheel 420 to prevent the take-up wheel 420 from being rolled contrary to its dispensing direction. Such a feature is helpful to prevent a user from erroneously unwinding the dispensing tape 350 from the take-up wheel 420.

Figure 5B:
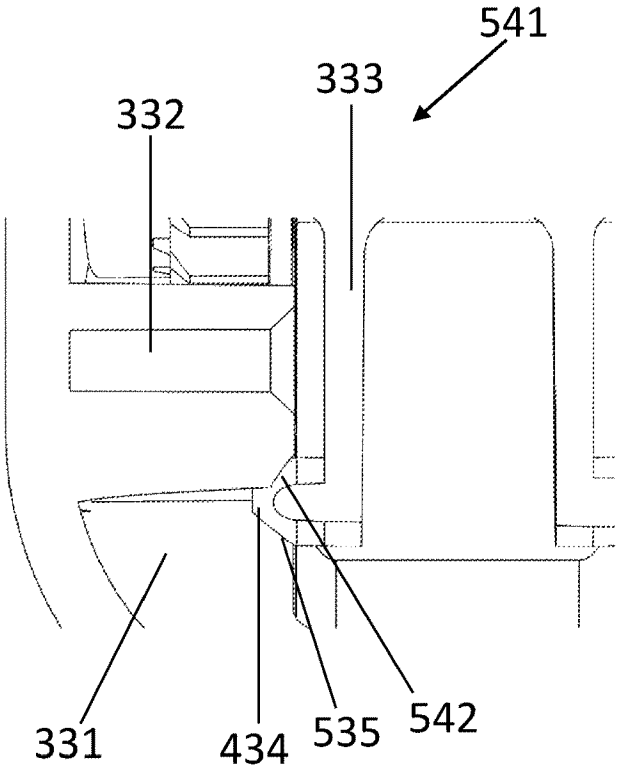
FIGS. 5A and 5B show a side, close-up view, of the locking mechanism of the apparatus.
Figure 5A:
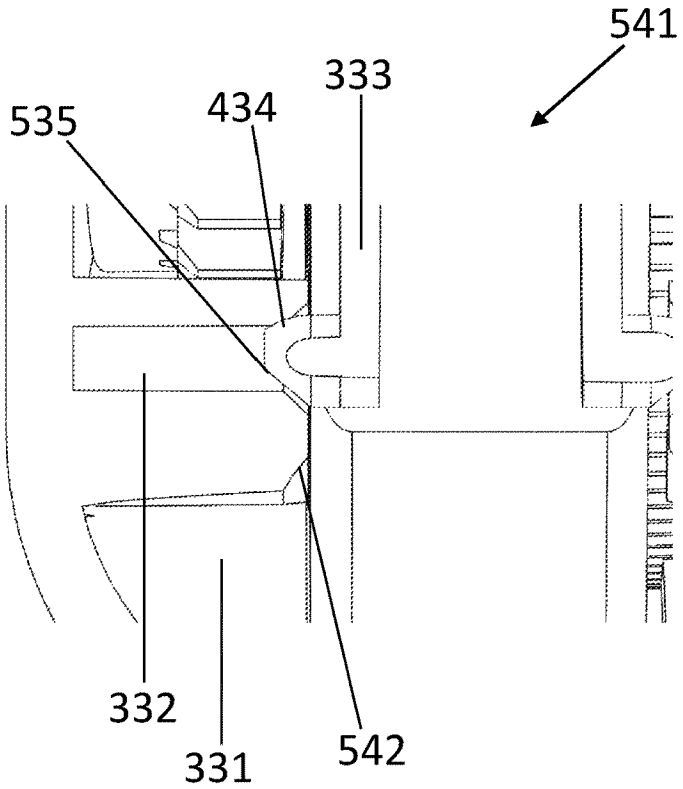

FIG. 5A shows a close-up, cutaway, side-view of the locking mechanism 342. The locking arm 333 is engaged with the second locking position 332 via the locking peg 434. In order to facilitate a smooth transition from the second locking position 332 to the first locking position 331, the locking peg 434 may be designed with a slanted surface 535, which enables the locking peg 434 to slide from the second locking position 332 to the first locking position 331.

FIG. 5B shows a close-up, cutaway, side-view of the locking mechanism 342. The locking arm 333 is engaged with the first locking position 331 via the locking peg 434. In order to facilitate a smooth transition from the first locking position 331 to the second locking position 332, the first locking position 331 may be designed with a slanted or contoured surface 542, which enables the locking peg 434 to slide from the first locking position 331 to the second locking position 332.

Figure 6C:
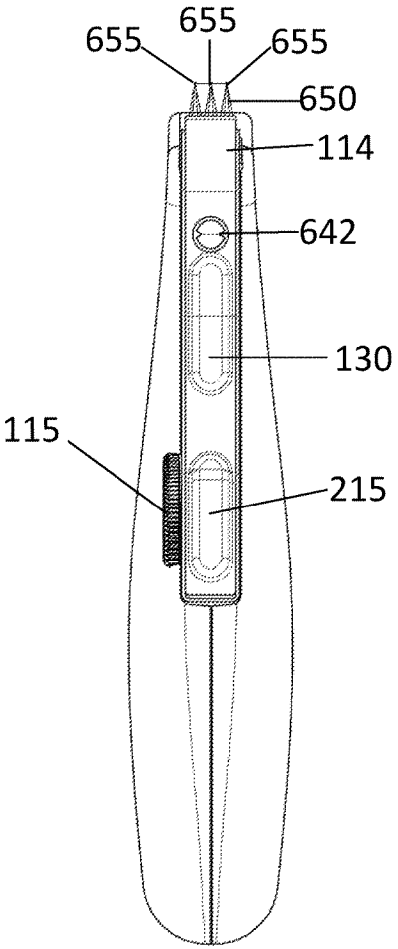
FIG. 6C is a plan view of the bottom of the apparatus.
Figure 6B:
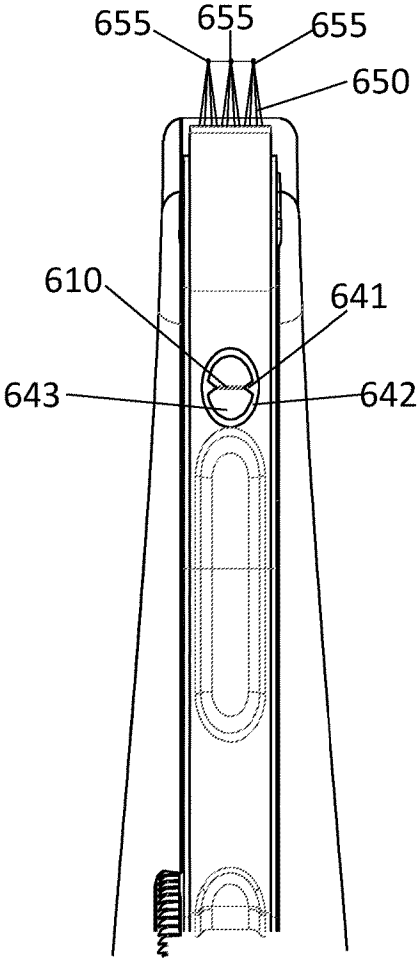
FIG. 6B is a close-up plan view of the bottom of the apparatus.
Figure 6A:
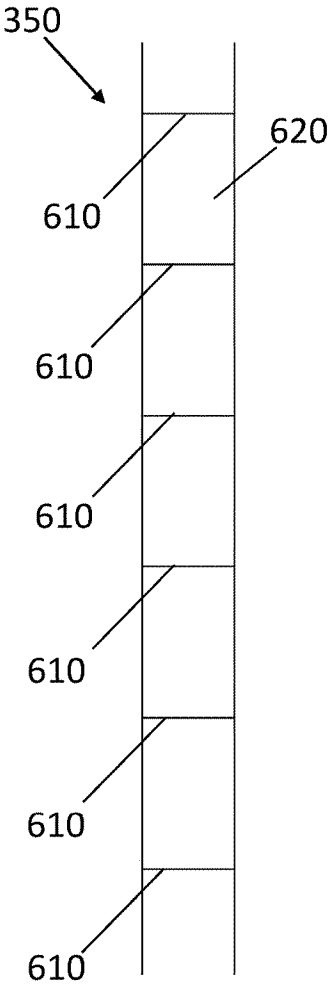
FIG. 6A shows a plan view of the tape, suitable for the apparatus herein.

FIG. 6A shows a plan view of a portion of tape 350, suitable for use in the apparatus of the present invention. In one embodiment, the tape 350 comprises a transparent or translucent surface. In another embodiment, the tape surface 620 is visually distinct from intermittent lines 610 on the tape 350. When the tape 350 is loaded into the apparatus of the present invention, the tape 350 is visible through the eyelet 642 as is shown in FIGS. 6B and 6C. The eyelet 642 comprises a window 643, through which the tape 350 is visible. When the false eyelashes 210 are advanced to an appropriate position for application to a user's eyelid or eyelash, a line 610 aligns with an alignment indicia 641, which prompts the user to depress the second button 130, activating the lower clamp 114. After the false eyelashes 210 are applied to the user's eyelid or eyelash, the user depresses the first button 125, and is free to advance the tape 350 with the actuating wheel 115. The distal ends 655 of the false eyelashes 210 are applied to a user's eyelash. The distal end 655 of the false eyelashes 210 may be pretreated with a user-acceptable adhesive to affix the false eyelashes 210 to the user's eyelash. Suitable eyelash adhesives are commercially available from, for example, DUO®.

Figure 7:
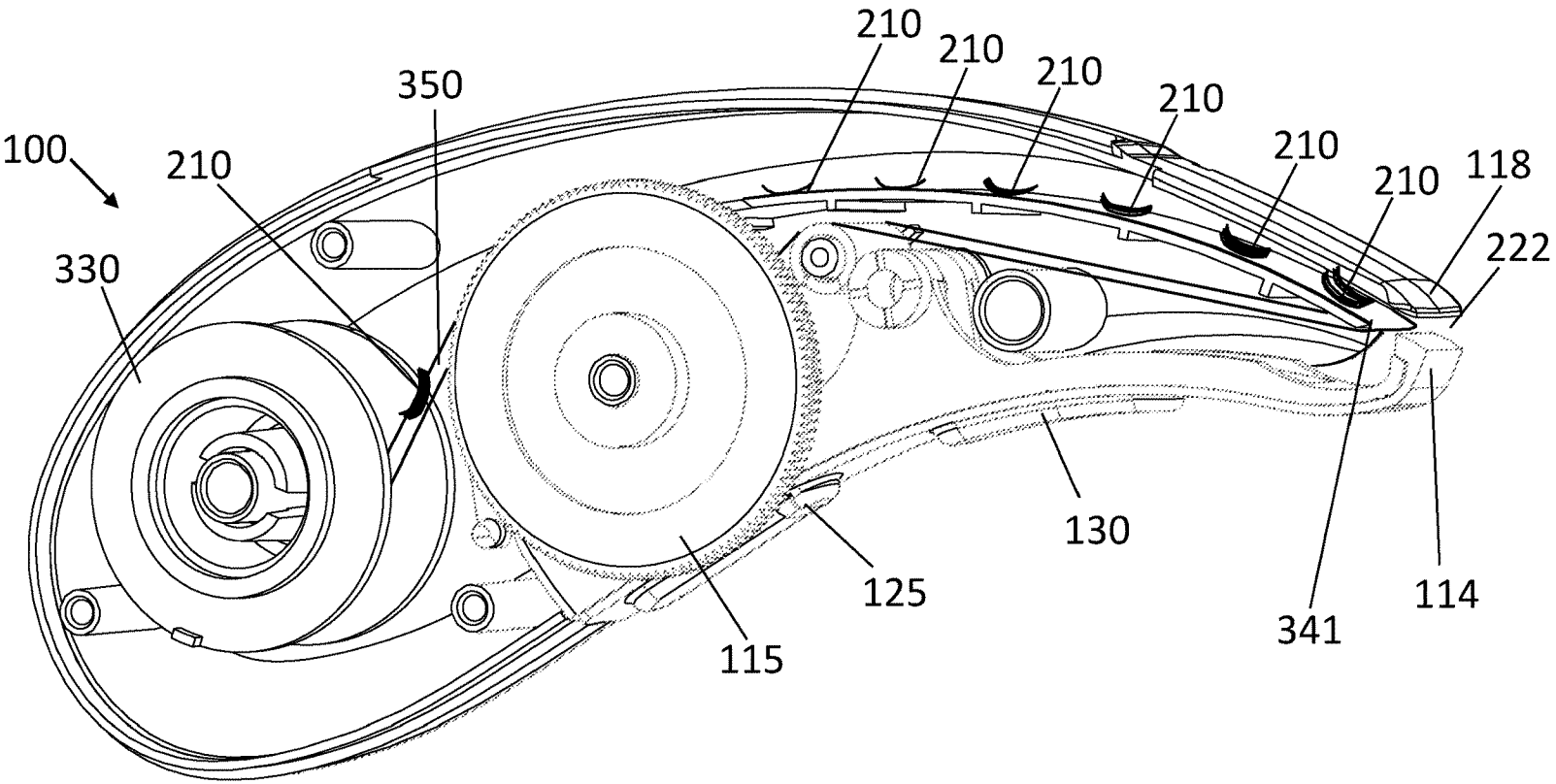
FIG. 7 is an isometric cutaway view of the side of the apparatus, loaded with false eyelashes.

FIG. 7 shows the apparatus 100, as false eyelashes 210 are dispensed on the tape 350 from the supply wheel 330. The actuating wheel 115 rotates forward, advancing false eyelashes 210 towards the dispensing tip 341, and dispensing the false eyelashes 210 through the opening 222. As has been previously discussed, the opening 222 is provided by locking the lower clamp 114 into the open position by depressing the first button 125. As the false eyelashes are dispensed through the opening 222, the user closes the lower clamp 114 by depressing the second button 130. With the false eyelashes 210 secured between the closed lower clamp 114 and upper clamp 118, the false eyelashes 210 are stabilized and secured, which provides improved accuracy and control as the false eyelashes 210 are applied to a user's eyelid or eyelash. As the false eyelash 210 is applied to the user's eyelash or eyelid, the user applies light pressure to the false eyelash 210 at the application site for a period of time. Once the adhesive adheres to the application site, the user unlocks the lower clamp 114, releasing the applied false eyelash 210, and pulls the apparatus 100 away from the eye. This process is repeated until the desired cosmetic appearance is achieved. The false eyelashes 210 are secured to the tape 350 by a cosmetically acceptable adhesive. And therefore, the adhesive applied to the false eyelashes 210 to fix the false eyelashes 210 to the eyelid or eyelash of a user must provide a sufficient tension force to release the false eyelashes 210 from the tape 350 after the false eyelashes 210 are applied to a user's eyelid or eyelash.

The apparatus herein may be preloaded with false eyelashes of varying lengths, shapes, and orientations to achieve a variety of cosmetic effects. In one embodiment, the apparatus is preloaded with a predetermined number of short, medium, and long false eyelashes. The apparatus may also include instructions or depict a template for applying the false eyelashes of varying lengths to achieve a particular cosmetic effect. Preloading the apparatus with such false eyelashes, and providing instructions for their application, improves the overall user experience as compared to currently known approaches for applying false eyelashes. Specifically, the predetermined assortment of lashes in each apparatus allows the user to select a particular apparatus based on a specifically desired cosmetic appearance at the point of sale. For example, the first false eyelashes may consist of short false eyelashes, and the next ten may consist of medium eyelashes, and the next ten may consist of long eyelashes. Of course, any predetermined ratio of short, medium, and long eyelashes may be employed.

Figure 8:
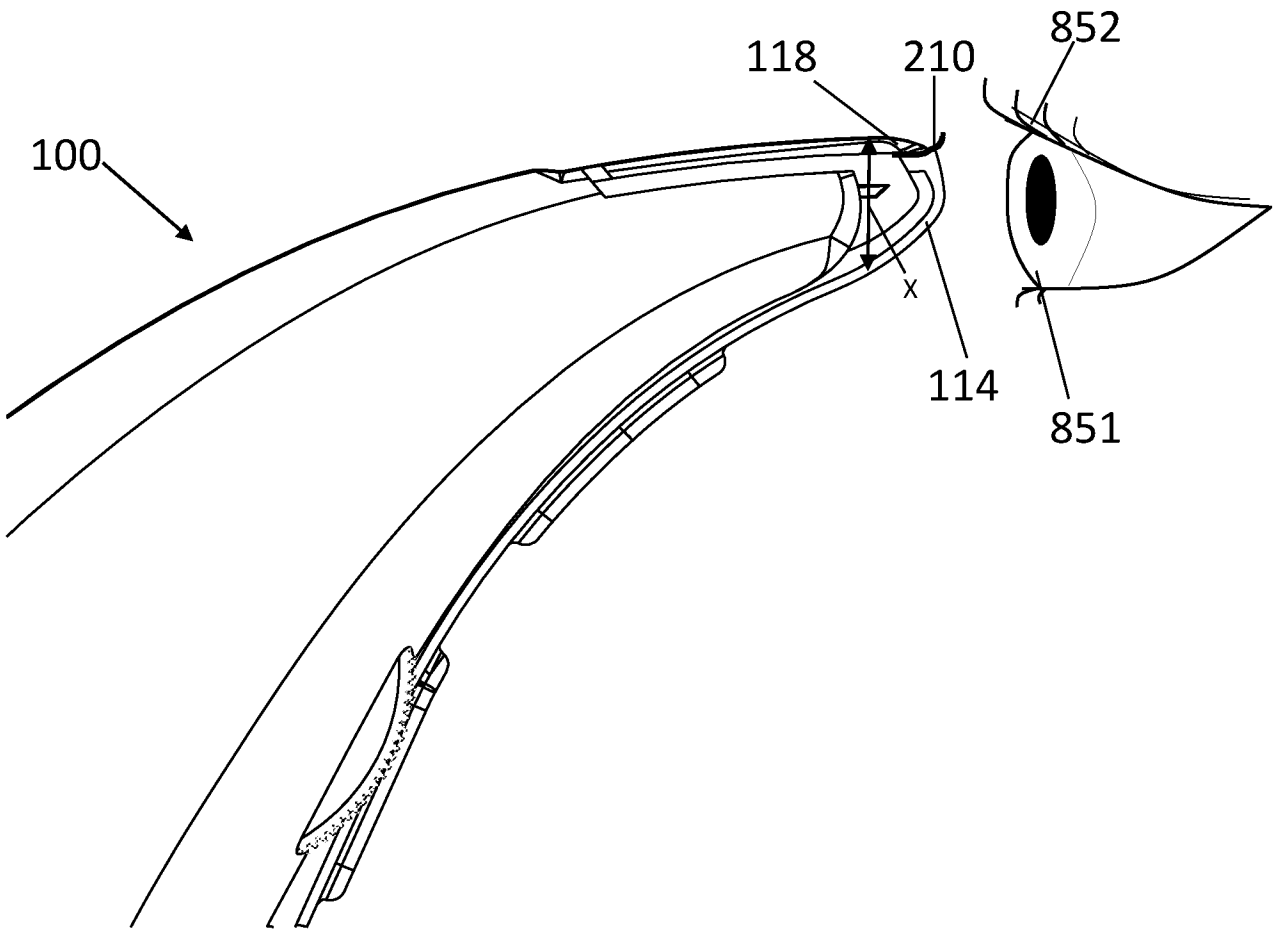
FIG. 8 is a side view of the apparatus just prior to application to a user's eyelid.

FIG. 8 shows a side view of the apparatus 100 just prior to application of false eyelashes 210 to a user's eyelid 852. It has been found that minimizing the size of distance "x", as shown in FIG. 8, measured from the upper clamp 118 to the lower clamp 114, and against the outer edge of the apparatus 100, is advantages for application of false eyelashes 210 to the user's eyelid 852. Therefore, the distance "x" should be less than about 1 cm, preferably less than about 0.5 cm, and most preferably, less than about 0.3 cm in length. Most preferably, the upper clamp 118 and lower clamp 114 should meet at a point, with a minimal distance between the two features. Minimizing distance "x" allows the user to apply the false eyelashes 210 to a user's eyelid 852 with an increased range of motion. If the distance "x" is too large, the user is much more likely to contact the user's eye 851 with the lower clamp 114 as the false eyelashes 210, are applied to the user's eyelid 852.

What is claimed is:

1. An apparatus for dispensing false eyelashes comprising an opening for dispensing false eyelashes, a supply wheel, a dispensing tip, a take-up wheel, the supply wheel carrying a supply roll of transparent or translucent tape, said tape comprising a plurality of false eyelashes, said false eyelashes being secured to said tape by a cosmetically acceptable adhesive, and said eyelashes being configured such that distal ends of each of said false eyelashes is directed towards said dispensing tip, and wherein the take-up wheel receives spent tape after each false eyelash is dispensed at the dispensing tip, the carrier tape extending from the supply wheel and around the dispensing tip, such that the distal end of the eyelash is exposed as said tape advances, and the spent tape proceeds to said take-up wheel, and wherein a dispensing actuator wheel is provided to drive rotation of said supply wheel, said actuator wheel protruding from an opening in said apparatus, and wherein said apparatus comprises a first and second button, said buttons being capable of opening and closing a lower clamp against an upper clamp, and wherein said apparatus further comprises an eyelet, said eyelet providing an alignment indicia corresponding with pre-defined lines on said tape, the alignment of which indicates proper positioning of at least one of said false eyelashes prior to application by a user.

2. An apparatus according to claim 1, wherein said apparatus comprises a predetermined number of short, medium, and long false eyelashes.

3. An apparatus according to claim 1, wherein said lower clamp is engaged by a locking mechanism, capable of locking the apparatus into at least a first and second position.

4. An apparatus according to claim 1, wherein said first and second buttons each comprise a tactile surface.

5. An apparatus according to claim 4, wherein the tactile surface with respect to each of said first and second buttons is different from one another.

6. An apparatus according to claim 1, wherein said take-up wheel is engaged by an anti-rollback means.

7. An apparatus according to claim 1, wherein a distance between said upper clamp and said lower clamp is less than about 1 cm when said upper clamp and said lower clamp are closed.

* * * * *